US010892128B2

(12) United States Patent
Liu et al.

(10) Patent No.: US 10,892,128 B2
(45) Date of Patent: Jan. 12, 2021

(54) RESIDUAL CURRENT PROTECTION DEVICE AND TRIPPER

(71) Applicant: ABB S.p.A., Milan (IT)

(72) Inventors: Wensheng Liu, Guangdong (CN); Jiancheng Ren, Guangdong (CN); Baiqin Liang, Guangdong (CN)

(73) Assignee: ABB S.P.A., Baden (CH)

( * ) Notice: Subject to any disclaimer, the term of this patent is extended or adjusted under 35 U.S.C. 154(b) by 147 days.

(21) Appl. No.: 16/366,181

(22) Filed: Mar. 27, 2019

(65) Prior Publication Data

US 2019/0304730 A1 Oct. 3, 2019

(30) Foreign Application Priority Data

Mar. 30, 2018 (CN) ..... 2018 2 0466598 U

(51) Int. Cl.
*H01H 71/12* (2006.01)
*H01H 71/58* (2006.01)
(Continued)

(52) U.S. Cl.
CPC ..... *H01H 71/128* (2013.01); *H01H 71/125* (2013.01); *H01H 71/58* (2013.01); *H01H 71/1009* (2013.01); *H01H 83/144* (2013.01)

(58) Field of Classification Search
CPC .... H01H 71/128; H01H 71/125; H01H 71/58; H01H 71/1009; H01H 83/144
See application file for complete search history.

(56) References Cited

U.S. PATENT DOCUMENTS

2017/0271106 A1* 9/2017 Dumont ..... H01H 21/30

FOREIGN PATENT DOCUMENTS

CN 203071024 U 7/2013
DE 102009020142 A1 11/2010

OTHER PUBLICATIONS

European Patent Office, Extended European Search Report issued in corresponding European application No. 19164907.8, dated Jul. 31, 2019, 5 pp.

* cited by examiner

*Primary Examiner* — Mohamad A Musleh
(74) *Attorney, Agent, or Firm* — Taft Stettinius & Hollister LLP; J. Bruce Schelkopf

(57) ABSTRACT

The present application provides a residual-current protection device and a tripper. The residual-current protection device comprises: a flux transformer receiving a residual-current signal; a tripping output element outputting ON/OFF signals; an energy storage mechanism adapted to switch between an energy storage state and an energy release state, the energy storage mechanism having a locking unit that locks the energy storage mechanism in the energy storage state; and a transmission mechanism braked by the flux transformer, which drives the tripping output element to move and drives state of the energy storage mechanism to switch; the transmission mechanism comprising: a first rack cooperating with the locking unit, a second rack driving the tripping output element, and a reduction gear with a big gear engaged with the first rack and a small gear engaged with the second rack. By means of the gear rack transmission mechanism of the residual-current protection device, reduction transmission can be effected, driving force needed by energy storage may be reduced, and thus design requirements as high transmission efficiency, easy processing and assembly as well as low costs can be satisfied.

17 Claims, 8 Drawing Sheets

(51) Int. Cl.

| | |
|---|---|
| *H01H 71/10* | (2006.01) |
| *H01H 83/14* | (2006.01) |

RESIDUAL CURRENT PROTECTION DEVICE AND TRIPPER

FIELD

The present application relates to the field of circuit breakers, and more specifically, to a residual current protection device and a tripper.

BACKGROUND

Circuit breakers are widely applied to middle and low voltage circuits to distribute power and protect lines, power sources and electric equipment. Usually, a tripper is assembled on a circuit breaker, and the tripper is used to perform protection functions, such as overload protection, short circuit protection, delay protection and leakage protection. Besides the protection functions, the circuit breaker is further configured with a residual-current protection device. Residual current, which is also called excess current, after-current or leakage current, refers to a current with a nonzero sum of all phase current vectors in a low-voltage distribution line.

The residual-current protection device is a protector that switches on the electric connection from a supply line to a load under a normal operating condition, triggers a contact action of the circuit breaker and thus breaks the supply line when the residual current on the supply line exceeds a predetermined scope under a specified condition. The residual-current protection device is intended to accomplish a residual current protection function and thereby guarantee the security of people and systems. The residual-current protection device may be used in cooperation with a moulded case circuit breaker so as to prevent the residual current from causing electric shock and fire accidents.

At present, the residual-current protection device generally trips the circuit breaker by triggering a flux transformer that receives a residual current signal so that an armature of the flux transformer pops out to directly hit a trip lever of the circuit breaker. With the increase of the capacity of the circuit breaker, the residual-current protection device needs to provide a larger trip force. Therefore, impact force of the flux transformer has to be increased, accordingly, the power and volume of the flux transformer need to be risen, and requirements on the product space and design of a control circuit are also enhanced. This can barely meet the design requirement as miniaturization.

In addition, to ensure the residual-current protection device to effect stable trip, products on existing markets adopt energy storage mechanisms and transmission mechanisms which are complexly designed, and need a numbers of components and parts. For stable and reliable functionality, it also demands high coordination between components and parts, which complicates the processing and assembly, further increases costs, and is also adverse to the development trend of miniaturization.

SUMMARY

In view of the above, the present application provides a residual-current protection device and a tripper that can at least partly overcome or relieve one or more technical problems in the prior art.

According to a first aspect of the present application, a residual-current protection device is provided. The residual-current protection device includes: a flux transformer receiving a residual-current signal; a tripping output element outputting ON/OFF signals; an energy storage mechanism adapted to switch between an energy storage state and an energy release state, the energy storage mechanism having a locking unit that locks the energy storage mechanism in the energy storage state; and a transmission mechanism braked by the flux transformer, which drives the tripping output element to move and drives the state of the energy storage mechanism to switch, the transmission mechanism comprising a first rack cooperating with the locking unit, a second rack driving the tripping output element, and a reduction gear, having a big gear engaged with the first rack and a small gear engaged with the second rack.

By means of the gear rack transmission mechanism of the residual-current protection device, reduction transmission may be obtained, driving force needed by energy storage may be reduced, and thus design requirements as high transmission efficiency, easy processing and assembly as well as low costs are satisfied.

According to some embodiments of the present application, the transmission mechanism includes a button and a slot body for the button to slide.

According to some embodiments of the present utility, the locking unit includes a U-shaped swing bar arranged within the slot body and a locking member adapted to change the shape of the slot body so as to control swing amplitude of the swing bar when the button is sliding. By means of the simple structural design, reliable self-locking functionality is achieved without increasing the volume of the protection device.

According to some embodiments of the present application, the locking member includes a stepped structure arranged on the first rack and a wedge linked with the button via a reset spring, step faces of the stepped structure being provided facing with a wedge face of the wedge. By means of the simple structural design, the swing amplitude of the swing bar can be controlled effectively, so that self-locking functionality is achieved.

According to some embodiments of the present application, the button and an end face of the first rack opposite thereto have overlapped portions. The button, when being pressed, may drive the first rack to move together, so that a second rack is driven via a reduction gear to move so as to enter energy storage state.

According to some embodiments of the present application, the button includes an integrally extended push rod that triggers the flux transformer to reset. This design makes it possible for the button and the flux transformer to be mutually triggered, which simplifies the structure.

According to some embodiments of the present application, the second rack is linked with a tripping output element via an energy storage spring.

According to some embodiments of the present application, the device includes a micro-switch mounted on a side of the first rack. When the residual-current protection device releases energy, the micro-switch is pressed via the first rack, and NC and NO contacts of the micro-switch feed trip signals back to a control circuit.

According to a second aspect of the present application, there is provided a tripper. The tripper includes: the residual-current protection device mentioned above; and a circuit breaker having a trip lever; the tripping output element striking the trip lever when the energy storage mechanism is in energy release state.

According to some embodiments of the present application, the residual-current protection device is mounted on a casing of the transformer.

In summary, the residual-current protection device and the tripper as provided in the present disclosure adopt a simple and reliable self-locking mode, with an easy triggering structure design in combination with gear rack reduction transmission. The whole protection device, only with several components, reduces the driving force needed by energy storage, significantly reduces the force needed by triggering, and satisfies design requirements as high transmission efficiency, simple processing and assembly and low costs. Meanwhile, the present protection device has a small volume, interspace arrangement between the residual-current transformer and the casing is used without requiring extra space, and further the design requirement for the control circuit is low.

BRIEF DESCRIPTION OF THE DRAWINGS

In the accompanying drawings, the similar/same reference numerals usually refer to the similar/same parts throughout different views. The accompanying drawings do not necessarily to be drawn in proportion but are diagrams that usually emphasize principles of the present application. In the accompanying drawings.

DETAILED DESCRIPTION OF EMBODIMENTS

Various embodiments of the present disclosure will be described in detail with reference to the accompanying drawings. One or more examples of the embodiments are shown by the accompanying drawings. The embodiments are provided by illustration of the present disclosure and not intended to limit the present disclosure. For example, features described or shown as a part of an embodiment might be used in another embodiment to generate a further embodiment. The present disclosure is intended to include these and other modifications and alterations belonging to the spirit and scope of the present disclosure.

As discussed in the BACKGROUND, with the increase of the capacity of the circuit breaker, it requires the residual-current protection device to provide a larger trip force. Therefore, impact force of the flux transformer has to be increased, and accordingly the power and volume of the flux transformer need to be risen, and requirements on the product space and design of a control circuit are also enhanced. This can barely meet the design requirement as miniaturization.

To this end, the concept of the present application is to reduce driving force needed by energy storage and achieve efficient transmission through reduction gears being linked with a first rack that is cooperating with a locking unit and a second rack that drives a tripping output element. Meanwhile, the overall design is simple and the volume is small, which well meets design requirements as miniaturization and low costs.

A residual-current protection device of the present application mainly includes a flux transformer, a tripping output element, an energy storage mechanism that is adapted to switch between an energy storage state and an energy release state and can be locked in the energy storage state, as well as a transmission mechanism braked by the flux transformer. By driving the transmission mechanism and storing, by the energy storage mechanism, energy as well as locking, the residual-current protection device may be set in the energy storage state, at which point the tripping output element is reset. When a leakage current is detected, the flux transformer receives a signal to drive the transmission mechanism. Then the transmission mechanism drives the energy storage mechanism to enter the energy release state from the locked energy storage state, so as to bring the tripping output element to move to a trip position, so as to strike or touch a trip lever of a circuit breaker cooperating with the residual-current protection device to achieve tripping.

Figure 1:
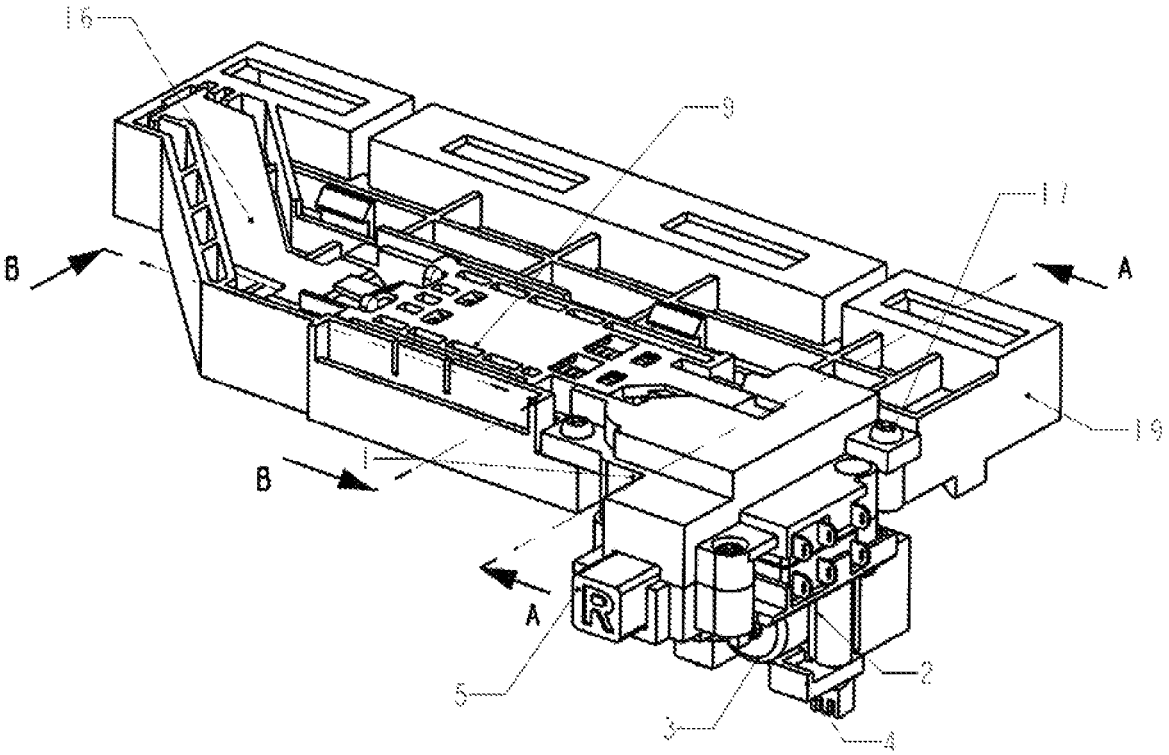
FIG. 1 shows an assembly schematic view in which a residual-current protection device is in an energy storage state according to an embodiment of the present application.

FIG. 1 shows an assembly schematic view in which a residual-current protection device is in the energy storage state according to an embodiment of the present application. As illustrated in FIG. 1, the residual-current protection device includes a flux transformer 3, a tripping output element, an energy storage mechanism and a transmission mechanism arranged within an upper casing 1 and a lower casing 2. The flux transformer 3 is mounted at the bottom of the lower casing 2 and is fastened by a fixing seat 4. Pressing a button 5 in FIG. 1 allows the residual-current protection device to be placed in the energy storage state. The tripping output element in the present disclosure is an ejection swing bar 16, which is in a reset position corresponding to the energy storage state.

Figure 2:
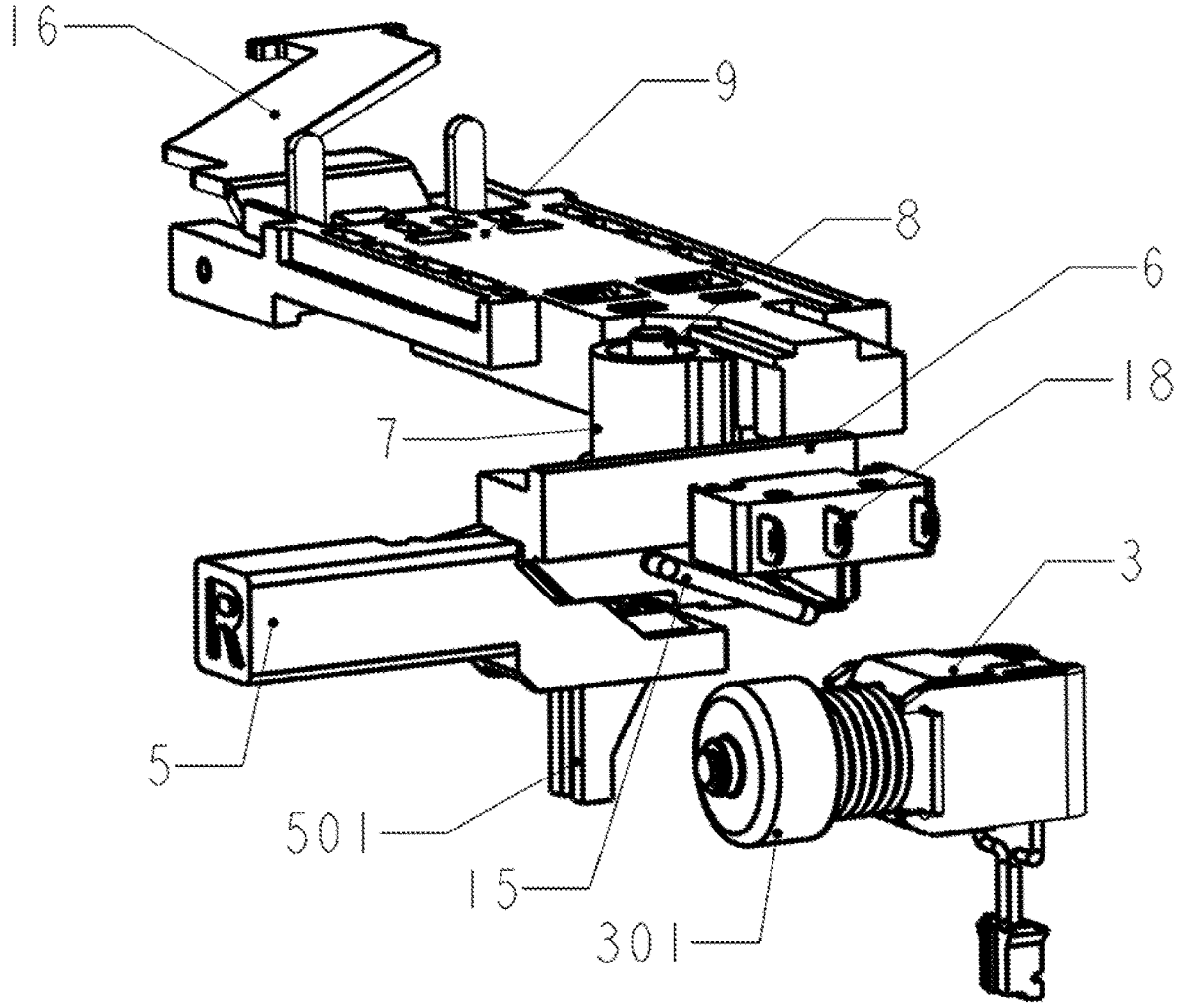
FIG. 2 shows an exploded schematic view in which a residual-current protection device is in an energy release state according to an embodiment of the present application.

FIG. 2 shows an exploded schematic view in which the residual-current protection device is in energy release state according to an embodiment of the present application. As illustrated in FIG. 2, the transmission mechanism includes a button 5 and a group of reduction gear racks. The button 5 integrally extends beyond a push rod 501. When the button 5 is pressed, the push rod 501 moves horizontally and touches an armature 301 of the flux transformer 3 to reset it. When the flux transformer 3 receives a leakage current signal, the armature 301 ejects and thus strikes the push rod 501 to cause the button 5 to move horizontally towards an opposite direction, so that the residual-current protection device releases energy. At this point, the ejection swing bar 16 is in a trip position corresponding to the energy release state.

Figure 6:
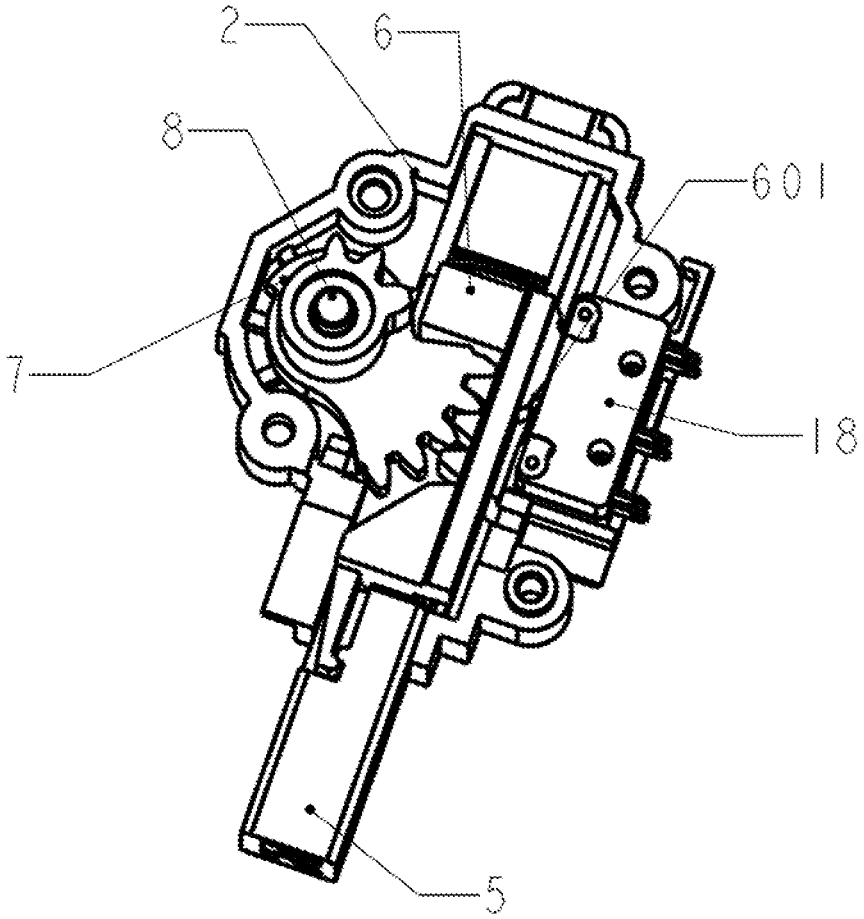
FIG. 6 shows a reduction transmission and signal feedback structure in a residual-current protection device according to an embodiment of the present application.
Figure 7:
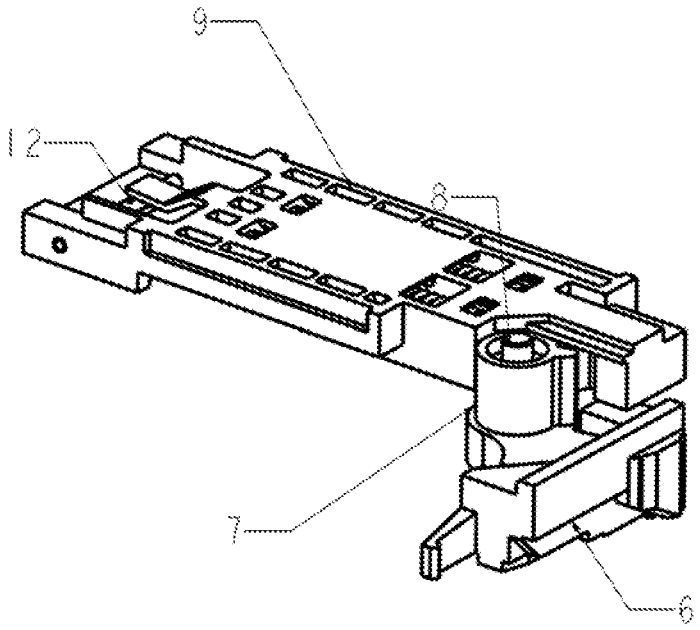
FIG. 7 shows a reduction transmission structure in a residual-current protection device according to an embodiment of the present application.

Still with reference to FIG. 2 in conjunction with FIGS. 6 and 7, the reduction gear rack is mainly composed of an intermediate gear 7, a driving rack 6 and an output rack 9. A spindle 8 is fixed on an enclosure, and the intermediate gear 7 is sleeved around the spindle 8 and can rotate freely. The driving rack 6 is engaged with a big gear of the intermediate gear 7, and the output rack 9 is engaged with a small gear of the intermediate gear 7. The driving rack 6 and the output rack 9 can slide within the upper casing 1 in directions perpendicular to each other. The button 5 and an end face of the driving rack 6 opposite thereto have overlapped portions. The button 5, when being pushed, drives the driving rack 6 via the overlapped portions to move towards the same direction.

Figure 3A:
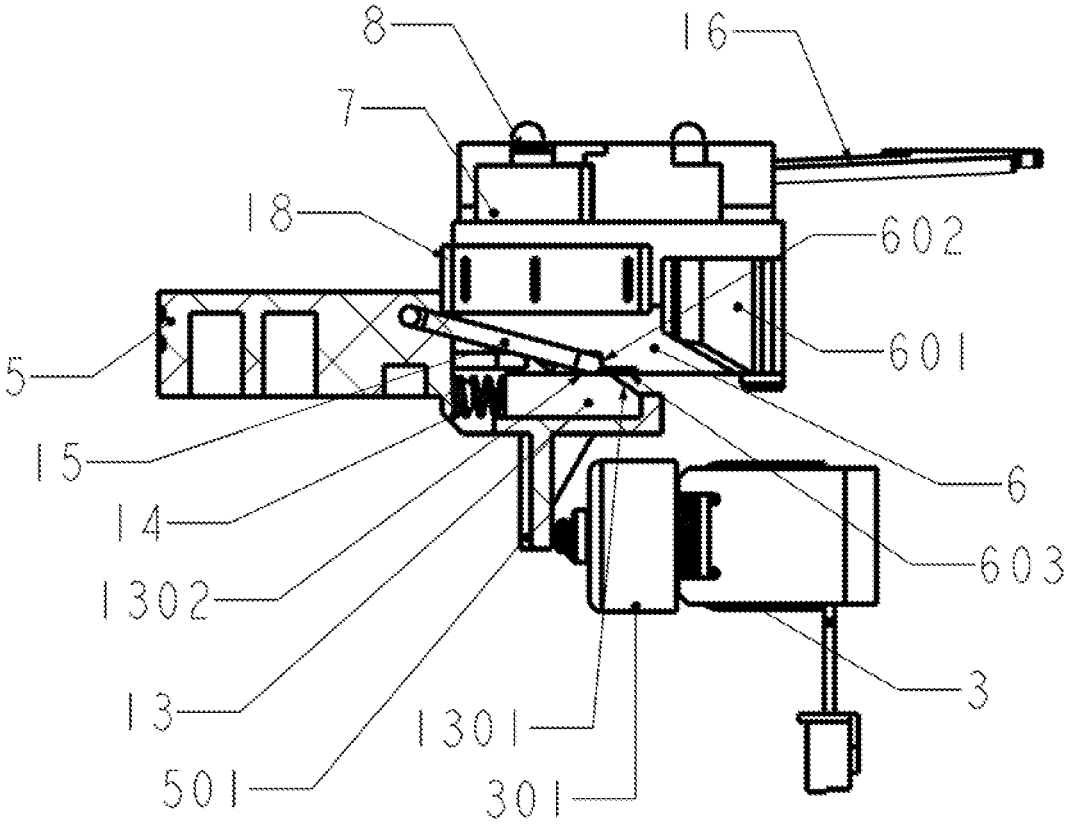
FIG. 3A is a cross-sectional view taken from FIG. 1 along A-A direction, showing the residual-current protection device in the energy storage state according to an embodiment of the present application.
Figure 3B:
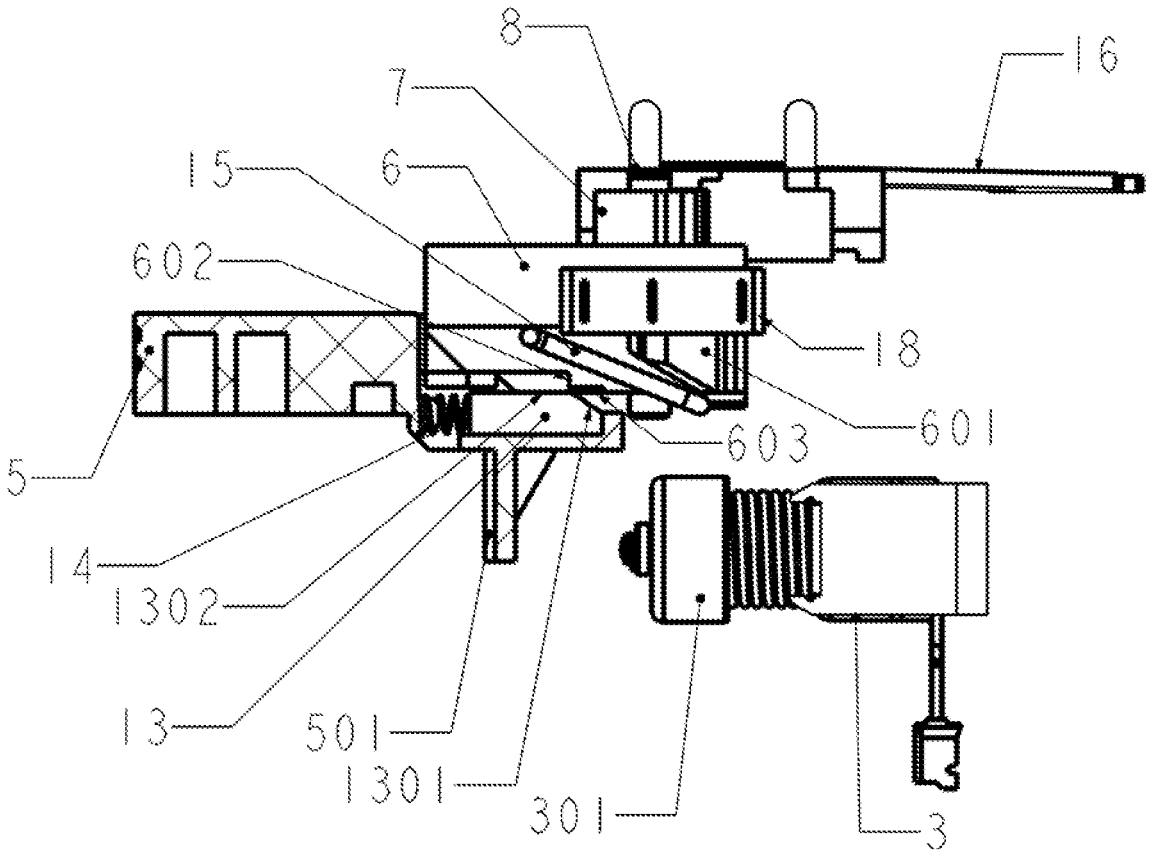
FIG. 3B is a cross-sectional view taken from FIG. 1 along A-A direction, showing the residual-current protection device in the energy release state according to an embodiment of the present application.
Figure 8:
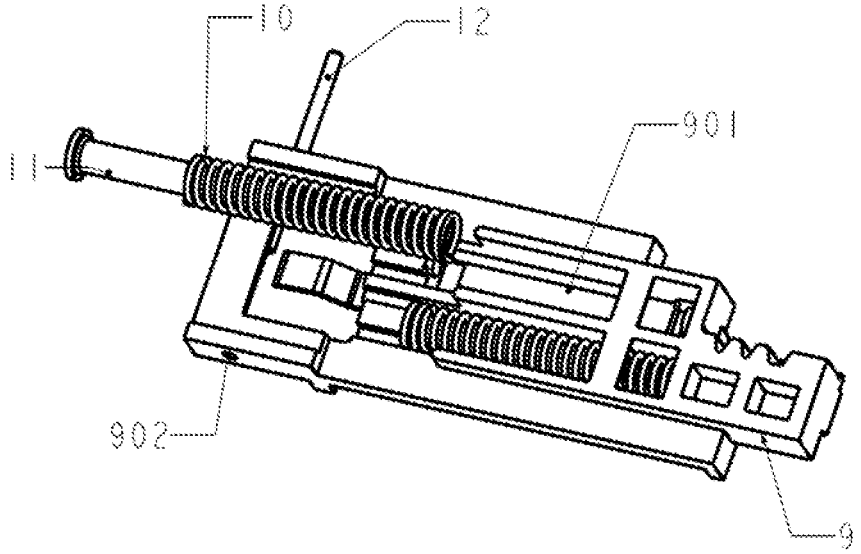
FIG. 8 shows an energy storage mechanism in a residual-current protection device, cooperating with an output rack and a tripping output element, according to an embodiment of the present application.

With reference to FIGS. 3A, 3B and 8 in conjunction with FIGS. 4 and 5, detailed description is made below to the energy storage mechanism of the residual-current protection device according to an embodiment of the present application. The energy storage mechanism mainly includes two portions: the first portion cooperating with the driving rack 6 and the button 5 as shown in FIGS. 3A and 3B, and the second portion cooperating with the output rack 9 and the ejection swing bar 16 as shown in FIG. 8.

With reference to FIGS. 3A and 3B, description is made to the first portion of the energy storage mechanism. FIGS. 3A and 3B are cross-sectional views taken from FIG. 1 along A-A direction, which respectively show the residual-current protection device in the energy storage state and the energy release state according to an embodiment of the present application. As shown in FIGS. 3A and 3B, the first portion of the energy storage mechanism mainly includes a locking wedge 13, a reset spring 14, a locking swing bar 15, and a stepped structure arranged on the driving rack 6 or integrated with the driving rack 6. The button 5 has a slot body fitting its sliding, and the locking wedge 13, the reset spring 14, the locking swing bar 15 and the stepped structure are substantially arranged within the slot body. By means of a shape structure design, when the button 5 slides, the locking wedge 13 and the stepped structure are adapted to change the shape of the slot body so as to control the swing amplitude of the locking swing bar 15, and thus form a locking member. Further, the locking member and the locking swing bar 15 in turn form a locking unit in the first portion of the energy storage structure. Specifically, the stepped structure has adjacent step faces 602 and 603 that are radially distal from inner walls of the slot body. The step face 603 is radially closer to inner walls of the slot body than the step face 602. The locking wedge 13 forms a linkage with the button 5 via the reset spring 14, and has a bevel 1301 facing the step faces 602 and 603 and a plane 1302 that is substantially parallel to the movement direction of the button 5. The step faces 602 and 603 are arranged opposite to the bevel 1301.

Figure 4A:
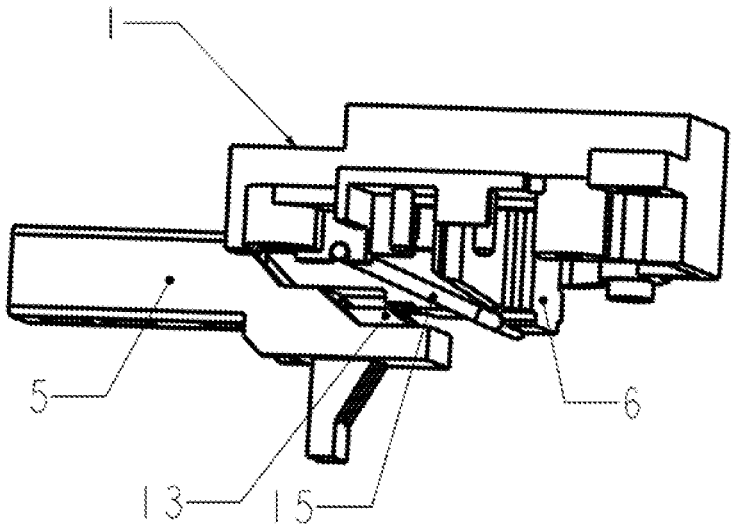
FIG. 4A is a schematic view of a locking structure in a residual-current protection device according to an embodiment of the present application.
Figure 4B:
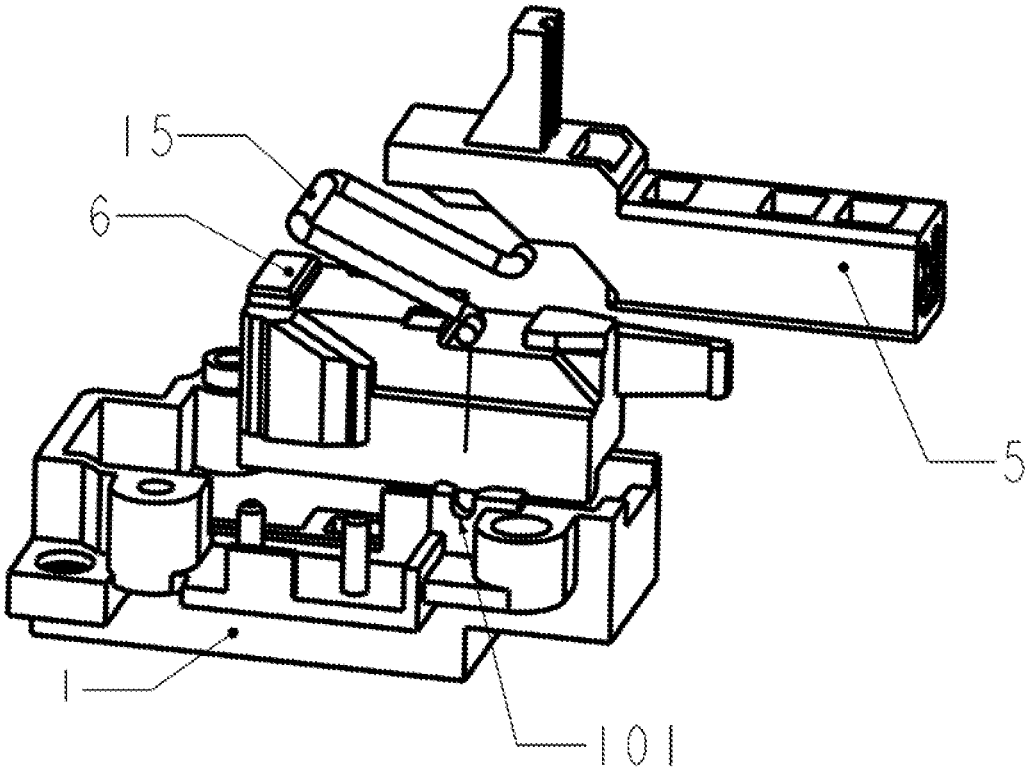
FIG. 4B is an exploded schematic view of a locking structure in a residual-current protection device according to an embodiment of the present application.

As shown in FIGS. 4A and 4B, the locking swing bar 15 is mounted on the enclosure and may be a U-shaped swing bar. The locking swing bar 15 is fastened in a U-shaped slot 101 of the upper casing 1, and the swingable end is clamped within the slot body of the button 5 with its swing amplitude controlled by the locking wedge 13 and the step faces 602 and 603 changing the shape of the slot body.

Figure 5:
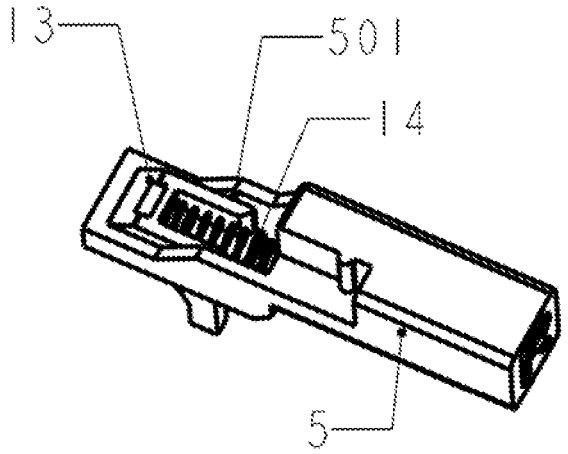
FIG. 5 is an assembly schematic view of a locking wedge in a residual-current protection device according to an embodiment of the present application.

FIG. 5 shows an assembly schematic view of the locking wedge 13. As illustrated in FIG. 5, the locking wedge 13 has a hollow portion for receiving the reset spring 14 via which the locking wedge 13 forms a linkage with the button 15.

FIG. 8 shows the second portion of the energy storage mechanism. As illustrated in FIG. 8, an energy storage spring 10 is sleeved around an energy storage spring guide rod 11, and the energy storage spring 10 and the energy storage spring guide rod 11 are mounted within a spring slot 901 of the output rack 9. A cylindrical pin 12 is inserted in a cross hole 902 of the output rack 9 to push the ejection swing bar 16 to rotate.

Figure 9:
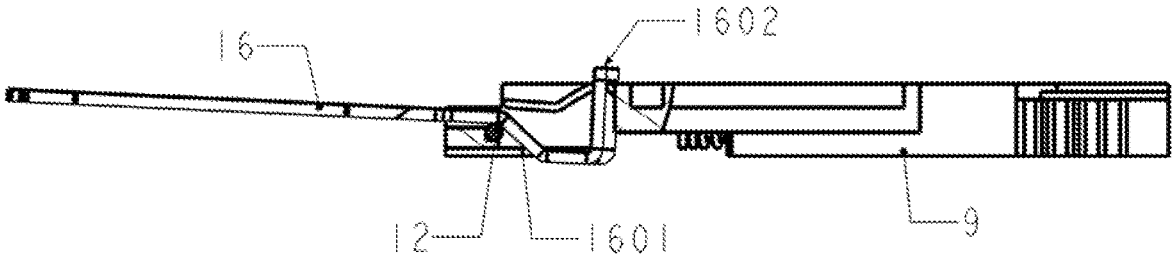
FIG. 9 shows a schematic view in which a tripping output element of a residual-current protection device is in the energy storage state according to an embodiment of the present application.
Figure 10:
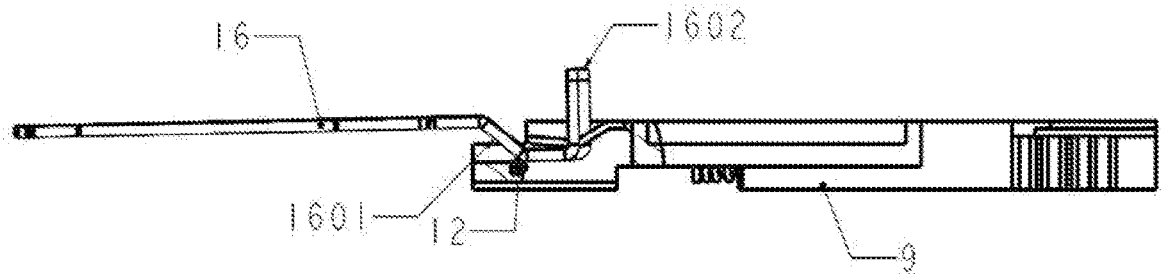
FIG. 10 shows a schematic view in which a tripping output element of a residual-current protection device is in the energy release state according to an embodiment of the present application.

Next, reference is made to FIGS. 9 and 10 in conjunction with FIG. 1. The ejection swing bar 16 has a bent portion 1601 and a contact claw 1602 arranged on top. The bent portion 1601 of the ejection swing bar 16 presses on the cylindrical pin 12 on the output rack 9. In the energy release state, the cylindrical pin 12 pushes the bent portion 1601 of the ejection swing bar 16 to rotate, and the contact claw 1602 on top of the ejection swing bar goes up so as to trigger the trip lever of the circuit breaker to be tripped.

Referring again to FIG. 6, the residual-current protection device according to an embodiment of the present application may be further provided with a micro-switch mounted on the side of the driving rack 6 in an overlapping manner and fixed by pillars of the upper casing 1 and the lower casing 2. When the residual-current protection device releases energy, a boss 601 on the driving rack 6 presses the micro-switch 18, and NC and NO contacts of the micro-switch feed trip signals back to the control circuit.

Accordingly, a tripper having the present protection device has a circuit breaker with a trip lever. The tripping output element strikes the trip lever to effect tripping when the energy storage mechanism is in energy release state. The present protection device may be mounted on a casing of a transformer 19 via a screw 17, and the energy storage spring guide rod 11 on the output rack 9 abuts against a boss 1901 of the casing of the transformer 19.

Figure 11:
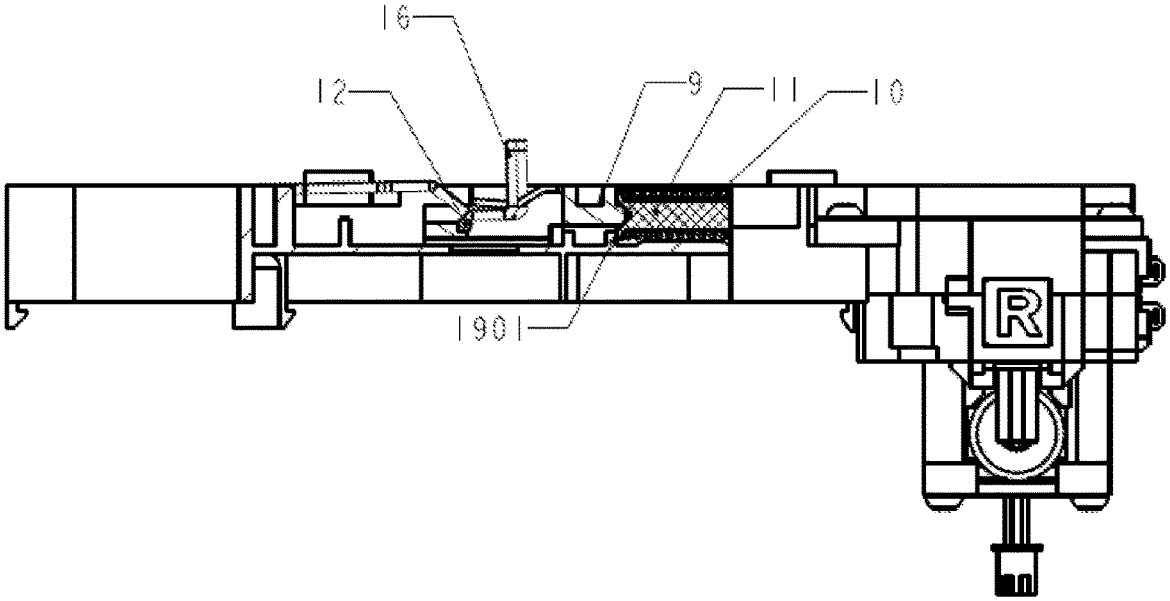
FIG. 11 is a cross-sectional view taken from FIG. 1 along B-B direction, showing a schematic view of the energy storage mechanism of FIG. 8 mounted on a casing of the transformer.

With reference to FIGS. 3A and 3B in conjunction with FIGS. 1 and 11, detailed illustration is presented below to the operation and running of the residual-current protection device according to embodiments of the present application.

As described above, the residual-current protection device has two states, i.e. the energy storage state and the energy release state. The energy storage state needs to be enabled by pressing the button 5.

During energy storage, the button 5 is pressed and the button 5 pushes the driving rack 6 to drive, through the intermediate gear 7, the output rack 9 at a reduced speed to compress the energy storage spring 10 for energy storage, and the output rack 9 stores the energy and presses down the ejection swing bar 16 so that the ejection swing bar 16 goes down and is reset. In the meantime, the button 5 drives the driving rack 6 to go forwards to the locking wedge 13 so that locking swing bar 15 abuts against the bevel 1301 of the locking wedge 13. Since the upside of the locking swing bar 15 is restricted by the plane of the driving rack 6 and cannot swing, the locking wedge 13 is pressed by the locking swing bar 15 to move in a direction opposite to the moving direction of the button 5.

When the button 5 drives the driving rack 6 to move further, the stepped structure of the driving rack appears, and the locking swing bar 15 obtains a space for swing. The locking wedge 13 is pushed by the reset spring 14, and the bevel 1301 of the locking wedge 13 pushes the locking swing bar 15 to rotate. When the locking wedge 13 is reset to the place 1302 of the locking wedge 13 and contacts with the locking swing bar 15, the place 1302 of the locking wedge 13 supports the locking swing bar 15.

When the button 5 is released, under the action of the energy storage spring 10, the output rack 9 drives the driving rack 6 through the intermediate gear 7 to slide for a small distance in a direction opposite to the direction for energy storage. The step face 603 of the driving rack 6 abuts against the locking swing bar 15 under the action of the energy storage spring 10. The locking swing bar 15 cannot swing as it is supported by the place 1302 of the locking wedge 13, the driving rack 6 springs back and is stopped by the locking swing bar 15, and thus the mechanism enters the energy storage state.

While the button 5 pushes the driving rack 6 for energy storage, the button 5 also pushes the flux transformer 3 to be reset. The boss 601 of the driving rack 6 at the energy storage position releases the micro-switch 18 button and feeds back a reset signal.

When the residual-current transformer and the control circuit detect a leakage current and send a trigger signal to the flux transformer 3, the armature 301 pops out to push the button 5, and then the button 5 drives the locking wedge 13 to disengage from the locking swing bar 15. Under the pushing force of the energy storage spring 10, the output rack 9 drives the step face 602 of the driving rack 6 via the intermediate gear 7 to push the locking swing bar 15 to swing, the driving rack 6 pushes away the locking swing bar 15, and then the protection device releases energy. Next, the cylindrical pin 12 on the output rack 9 pushes the bent portion 1601 of the ejection swing bar 16 so that the ejection swing bar 16 rotates. Then, the contact claw 1602 on top of the ejection swing bar 16 goes up, thereby causing the trip lever of the circuit breaker to trip.

Although the present application has been illustrated and described in detail in the accompanying drawings and the foregoing description, the illustration and description should be construed as illustrative or exemplary rather than limiting; the present application is not limited to the embodiments disclosed herein. While implementing the claimed invention, those skilled in the art may understand and implement other variations of the disclosed embodiments by studying the accompanying drawings, disclosure and appended claims.

In the claims, the word "comprise(s)/include(s)" and its derivatives does not exclude other elements, and the indefinite article "a" or "an" does not exclude the existence of a plurality of elements. A single element or other unit may satisfy functions of multiple items defined in the claims. The only fact that some features are sated in different embodiments or dependent claims does not mean combinations of these features cannot be used advantageously. The protection scope of the present application covers any possible combination of various features stated in various embodiments or dependent claims without departing from the spirit and scope of the present application.

We claim:

1. A residual-current protection device, comprising:

a flux transformer receiving a residual-current signal;

a tripping output element outputting ON/OFF signals;

an energy storage mechanism adapted to switch between an energy storage state and an energy release state, the energy storage mechanism having a locking unit that locks the energy storage mechanism in the energy storage state; and a transmission mechanism braked by the flux transformer, which drives the tripping output element to move and drives the energy storage mechanism to switch its state, the transmission mechanism including:

a first rack cooperating with the locking unit;

a second rack driving the tripping output element; and a reduction gear, having a big gear engaged with the first rack and a small gear engaged with the second rack.

2. The residual-current protection device according to claim 1, wherein the transmission mechanism comprises a button and a slot body for the button to slide.

3. The residual-current protection device according to claim 2, wherein the locking unit comprises a U-shaped swing bar arranged within the slot body and a locking member adapted to change the shape of the slot body so as to control swing amplitude of the swing bar when the button is sliding.

4. The residual-current protection device according to claim 3, wherein the locking member comprises a stepped structure arranged on the first rack and a wedge linked with the button via a reset spring, step faces of the stepped structure being provided opposite to a wedge face of the wedge.

5. The residual-current protection device according to claim 2, wherein the button and an end face of the first rack opposite thereto have overlapped portions.

6. The residual-current protection device according to claim 2, wherein the button comprises an integrally extended push rod that triggers the flux transformer to reset.

7. The residual-current protection device according to claim 1, wherein the second rack is linked with the tripping output element via an energy storage spring.

8. The residual-current protection device according to claim 1, wherein the device comprises a micro-switch mounted on a side of the first rack.

9. A tripper, comprising:

a residual-current protection device comprising:

a flux transformer receiving a residual-current signal;

a tripping output element outputting ON/OFF signals;

an energy storage mechanism adapted to switch between an energy storage state and an energy release state, the energy storage mechanism having a locking unit that locks the energy storage mechanism in the energy storage state; and a transmission mechanism braked by the flux transformer, which drives the tripping output element to move and drives the energy storage mechanism to switch its state, the transmission mechanism including:

a first rack cooperating with the locking unit;

a second rack driving the tripping output element; and a reduction gear, having a big gear engaged with the first rack and a small gear engaged with the second rack; and a circuit breaker having a trip lever;

the tripping output element striking the trip lever when the energy storage mechanism is in energy release state.

10. The tripper according to claim 9, wherein the tripper comprises a transformer, the residual-current protection device being mounted on a casing of the transformer.

11. The tripper according to claim 9, wherein the transmission mechanism comprises a button and a slot body for the button to slide.

12. The tripper according to claim 11, wherein the locking unit comprises a U-shaped swing bar arranged within the slot body and a locking member adapted to change the shape of the slot body so as to control swing amplitude of the swing bar when the button is sliding.

13. The tripper according to claim 12, wherein the locking member comprises a stepped structure arranged on the first rack and a wedge linked with the button via a reset spring, step faces of the stepped structure being provided opposite to a wedge face of the wedge.

14. The tripper according to claim 11, wherein the button and an end face of the first rack opposite thereto have overlapped portions.

15. The tripper according to claim 11, wherein the button comprises an integrally extended push rod that triggers the flux transformer to reset.

16. The tripper according to claim 11, wherein the second rack is linked with the tripping output element via an energy storage spring.

17. The tripper according to claim 9, wherein the device comprises a micro-switch mounted on a side of the first rack.

* * * * *